US008344713B2

(12) United States Patent
Shrivas et al.

(10) Patent No.: US 8,344,713 B2
(45) Date of Patent: Jan. 1, 2013

(54) LDO LINEAR REGULATOR WITH IMPROVED TRANSIENT RESPONSE

(75) Inventors: Mithlesh Shrivas, Noida (IN); Mayank Jain, Noida (IN)

(73) Assignee: Freescale Semiconductor, Inc., Austin, TX (US)

( * ) Notice: Subject to any disclaimer, the term of this patent is extended or adjusted under 35 U.S.C. 154(b) by 214 days.

(21) Appl. No.: 13/004,044

(22) Filed: Jan. 11, 2011

(65) Prior Publication Data

US 2012/0176107 A1 Jul. 12, 2012

(51) Int. Cl.
*G05F 1/56* (2006.01)

(52) U.S. Cl. ..... 323/273; 323/315

(58) Field of Classification Search ..... 323/268, 323/269, 270, 273, 274, 275, 276, 279, 315, 323/316; 361/111
See application file for complete search history.

(56) References Cited

U.S. PATENT DOCUMENTS 5,867,015 A * 2/1999 Corsi et al. ..... 323/316
6,522,111 B2 2/2003 Zadeh
6,819,165 B2 * 11/2004 Ho et al. ..... 327/541
6,933,772 B1 8/2005 Bannerjee
7,235,959 B2 6/2007 Sicard
7,498,780 B2 * 3/2009 Chen et al. ..... 323/273
7,508,177 B2 3/2009 Aiura
7,723,968 B2 5/2010 Okuyama
7,737,676 B2 6/2010 Kimura
7,821,240 B2 10/2010 Oddoart
7,834,601 B2 11/2010 Aiura
7,893,671 B2 * 2/2011 Sahni et al. ..... 323/280
8,040,118 B2 * 10/2011 Cho et al. ..... 323/273
2003/0218450 A1 11/2003 Bonte
2009/0195290 A1 * 8/2009 Moraveji ..... 327/331
2009/0315526 A1 12/2009 Do Couto
2010/0097047 A1 4/2010 Iimura
2010/0295524 A1 11/2010 Sicard
2011/0156674 A1 * 6/2011 Lin et al. ..... 323/282

* cited by examiner

*Primary Examiner* — Gary L Laxton
(74) *Attorney, Agent, or Firm* — Charles Bergere

(57) ABSTRACT

An LDO regulator system has first and second current mirror circuits connected to its output terminal. A load attached to the output terminal is supplied with a constant voltage. Variations in the load that cause variations in the magnitude of the output voltage trigger one of the first or second current mirror circuits to generate a current that varies the magnitude of a gate voltage of a pass-transistor. The variation in the gate voltage in turns varies the drain current of the pass-transistor, which varies the output voltage to counter the change in the magnitude of the output voltage. Using the first and second current mirror circuits avoids the need for a large load capacitor and very high bandwidth of a conventional LDO regulator.

5 Claims, 4 Drawing Sheets

- *Prior Art* -

LDO LINEAR REGULATOR WITH IMPROVED TRANSIENT RESPONSE

BACKGROUND OF THE INVENTION

The present invention relates to a Linear Dropout (LDO) regulator, and more specifically, to an LDO regulator with an improved transient response.

Recent years have seen tremendous advancements in the field of electronic circuits. One such advancement is in the area of providing a supply voltage used to operate electronic circuits. The supply voltage may vary due to various factors such as changes in the load of the circuit to which the voltage is being supplied, temperature variations, aging, and so forth. Variation of the supply voltage can affect the operation of the electronic circuit. Thus, a voltage regulator is used to maintain the output of the supply voltage at a predetermined value. Over the years, a few different types of regulators have been developed, such as a standard regulator, a low drop-out (LDO) regulator, and a quasi-LDO regulator, with LDO regulators being the most widely used.

FIG. 1 is schematic circuit diagram of a conventional LDO regulator 100. The LDO regulator 100 includes an error amplifier 102, a pass-transistor 104, a capacitor C1, and resistance network R1, R2.

The error amplifier 102 is connected to the gate of the pass-transistor 104. The source of the pass-transistor 104 is connected to a voltage supply (VDD) and the drain of the pass-transistor 104 comprises the output terminal of the LDO regulator 100. The capacitor C1, which may be either an internal capacitor or external to the regulator circuit, is connected to the output of LDO regulator 100. The resistance network R1 and R2 also is connected to the output of the LDO regulator 100 and in parallel with the capacitor C1. A node between the resistors R1 and R2 is connected to an input terminal of the error amplifier 102 and provides a scaled-down version of the output voltage to the error amplifier 102. The error amplifier 102 also receives a reference voltage signal that is generated by an external voltage reference circuit. The error amplifier 102 compares the reference voltage signal and the scaled down version of the output voltage signal to generate an error amplified signal, which is provided to the gate terminal of the pass-transistor 104. The error amplified signal is used to maintain the output of the LDO regulator 100 at a predetermined voltage.

The LDO regulator 100 generates a constant output voltage to the load (not shown) by providing the required load current. If the magnitude of the load current increases due to variations in the load, there is a corresponding drop in the magnitude of the output voltage. The drop in the output voltage leads to an increase in the magnitude of the error amplified signal generated by the error amplifier 102. The increase in the error amplified signal in turn increases the magnitude of the source-gate voltage of the pass-transistor 104, causing a corresponding increase in the magnitude of the drain current of the pass-transistor 104, and the increase in the drain current pulls up the output voltage. Thus, the magnitude of the output voltage signal is maintained at the predetermined voltage. The capacitor connected to the output terminal improves the transient response of the LDO regulator 100.

During steady-state operation, the magnitude of the output voltage signal is maintained at the predetermined value and the output capacitor C1 is charged to the magnitude of the output voltage signal. If the current of the load circuit changes abruptly and the main regulation loop, formed by the error amplifier 102, pass-transistor 104 and resistor network R1 and R2, may not respond quickly because it has a bandwidth limitation, the capacitor C1 provides the extra charge required by the load. As a result, the magnitude of the output voltage decreases or increases from the predetermined voltage value.

The magnitude of output voltage drop or rise can be improved by either increasing the bandwidth/speed of the main regulation loop or by increasing the value of the capacitor C1. However, such changes have associated constraints such as power consumption, silicon area, and overall cost of the system. To increase the bandwidth or speed of the main regulation loop, the DC current should be increased, which results in higher power consumption of the system and also increased die area. The capacitor C1 can be realized as either an internal or external capacitor. An external capacitor increases cost, while an internal capacitor cannot be made very large because that would require significant additional die area. Thus, there is a need for a circuit that improves the transient response of the LDO regulator yet avoids the above-mentioned constraints.

BRIEF DESCRIPTION OF THE DRAWINGS

The following detailed description of the preferred embodiments of the present invention will be better understood when read in conjunction with the appended drawings. The present invention is illustrated by way of example, and not limited by the accompanying figures, in which like references indicate similar elements.

DETAILED DESCRIPTION OF THE PRESENT INVENTION

Figure 1:
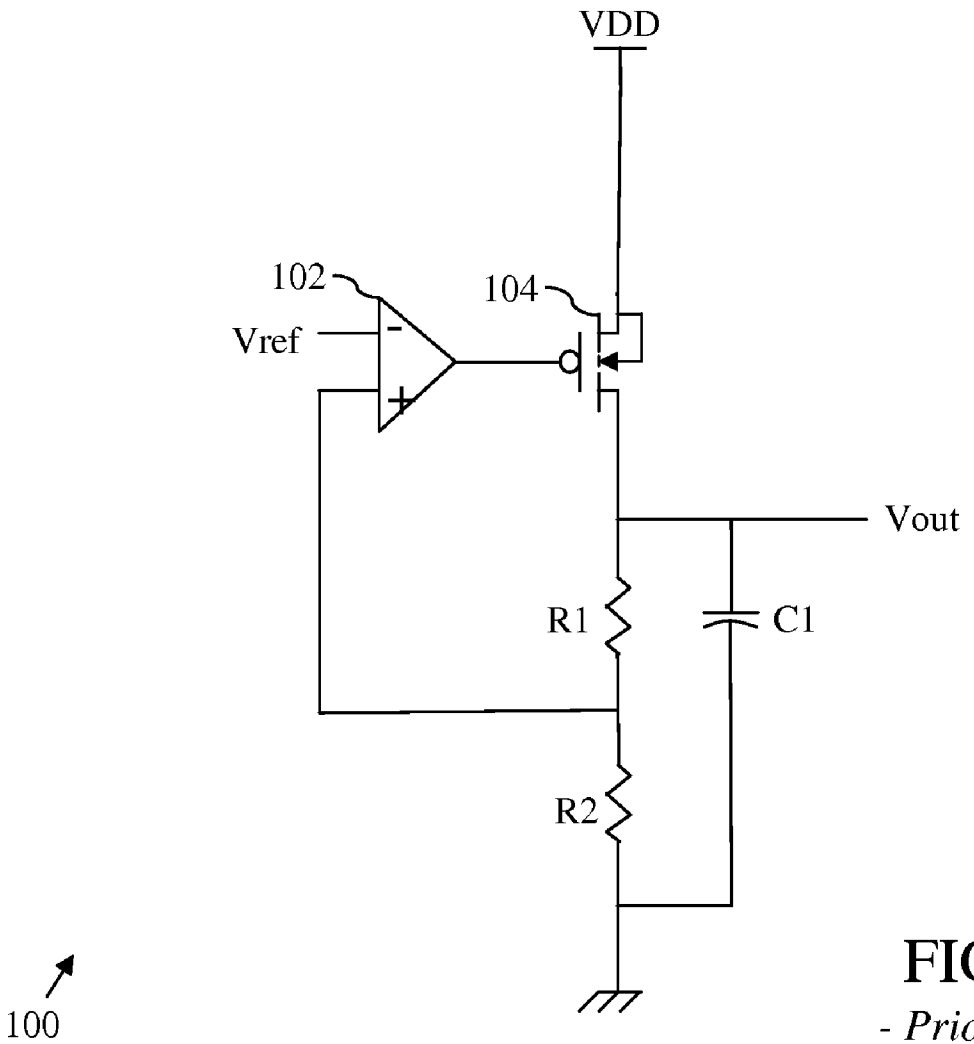
FIG. 1 is a schematic circuit diagram of a conventional LDO regulator.

The detailed description of the appended drawings is intended as a description of the currently preferred embodiments of the present invention, and is not intended to represent the only form in which the present invention may be practiced. It is to be understood that the same or equivalent functions may be accomplished by different embodiments that are intended to be encompassed within the spirit and scope of the present invention.

In an embodiment of the present invention, a voltage regulating system including a low dropout (LDO) regulator and a transient response enhancement circuit is provided. The low dropout regulator includes an error amplifier and a pass-transistor. The error amplifier compares an external reference voltage and a scaled-down version of an output voltage to generate an error amplified signal. The error amplified signal is fed to the gate terminal of the pass-transistor. The pass-transistor generates an output voltage signal based on the amplified error signal. The output voltage signal is fed to the transient response enhancement circuit. The transient response enhancement circuit includes a first current mirror and a second current mirror. The input terminals of the first and second current mirrors are connected to the drain terminal of the pass-transistor, and the output terminals of the first and second current mirrors are connected to the gate terminal of the pass-transistor.

If the load current increases abruptly due to change in the characteristics of the load attached to the voltage regulating system, the abrupt increase in the load current, in turn, leads to sudden drop in the output voltage. In this case, the first current mirror is activated. The current signal generated by the first current mirror is supplied to the gate terminal of the pass transistor 104 and pulls down the voltage at the gate terminal of the pass-transistor 104. The drop in gate terminal voltage increases the voltage difference between the gate terminal and the source terminal of the pass-transistor ($V_{sg}$) 104. The increase in magnitude of $V_{sg}$ increases the drain current which, in turns, pulls up the output voltage of the voltage regulator. In above case, the second current mirror is not activated. A similar function is performed by the second current mirror when the load current abruptly decreases leading to a sudden increase in the output voltage of LDO regulator. The second current mirror generates a current signal that pulls up the gate terminal voltage of the pass-transistor 104, which in turn decreases the drain current. As a result, the output voltage decreases. In this case, the first current mirror is not active. The above-described system does not require a large capacitor or large transistors and uses only a small do current to improve the transient response of the voltage regulator. As a result, the system does not have the limitations attached with a capacitor and main regulation loop bandwidth for transient response improvement. Thus, the system preserves silicon area.

Figure 2:
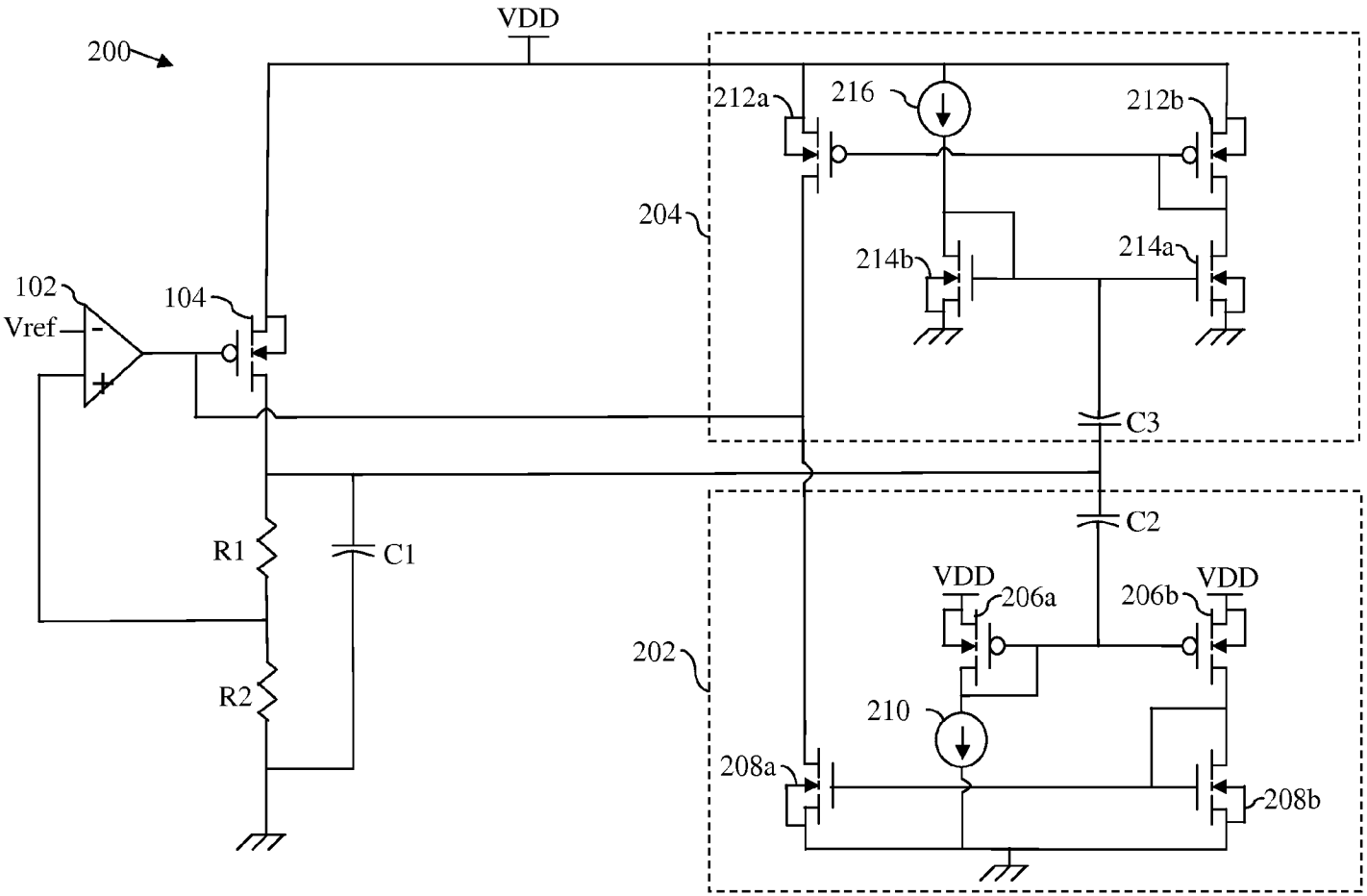
FIG. 2 is a schematic circuit diagram of a voltage regulator in accordance with an embodiment of the present invention.

Referring now to FIG. 2, a schematic circuit diagram of a voltage regulator 200 in accordance with an embodiment of the present invention is shown. The voltage regulator 200 includes an error amplifier 102, a pass-transistor 104, a first capacitor C1 and a resistance network having resistors R1 and R2, all of which are connected like those of the conventional LDO regulator 100 (FIG. 1). In addition, the drain terminal of the pass-transistor 104 is connected to a load (not shown).

The voltage regulator 200 also includes first and second current mirrors 202 and 204. The first current mirror 202 includes first and second PMOS transistors 206*a* and 206*b*, first and second NMOS transistors 208*a* and 208*b*, a first current source 210, and a second capacitor C2. The second current mirror 204 includes third and fourth PMOS transistors 212*a* and 212*b*, third and fourth NMOS transistors 214*a* and 214*b*, a second current source 216, and a third capacitor C3. The drain terminal of the pass-transistor 104 is connected to respective input terminals of the first and second current mirrors 202, 204 and output terminals of the first and second current mirrors 202, 204 are connected to the gate terminal of the pass transistor 104.

In the first current mirror 202, the first PMOS transistor 206*a* has a source terminal connected to a voltage source (VDD), a gate terminal connected to a gate terminal of the second PMOS transistor 206*b*, and a drain terminal connected to the first current source 210. The gate terminal of the first PMOS transistor 206*a* also is connected to the drain terminal of the first PMOS transistor 206*a* and consequently also to an input of the first current source 210. An output of the first current source 210 is connected to the ground. The second PMOS transistor 206*b* has a source terminal connected to the voltage source VDD and, as previously mentioned, the gate terminal of the second PMOS transistor 206*b* is connected to the gate terminal of the first PMOS transistor 206*a*. The drain terminal of the pass transistor 104 is connected to the gate terminals of the first and second PMOS transistors 206*a*, 206*b* by way of the input terminal of the first current mirror 202 and the second capacitor C2.

The first NMOS transistor 208*a* has a source terminal connected to ground, a gate terminal connected to a gate terminal of the second NMOS transistor 208*b* and a drain terminal connected to the gate terminal of the pass transistor 104 by way of an output terminal of the first current mirror 202. The second NMOS transistor 208*b* has a source terminal connected to the ground, a gate terminal connected to the gate terminal of the first NMOS transistor 208*a*, and a drain terminal connected to a drain terminal of the second PMOS transistor 206*b*. The drain terminal of the second NMOS transistor 208*b* also is connected to the gate terminals of the first and second NMOS transistors 208*a*, 208*b*.

The first PMOS transistor 206*a* and the first current source 210 act as a biasing circuit for the second PMOS transistor 206*b*. During steady-state operation of the voltage regulator 200, the second PMOS transistor 206*b* operates in the saturation region and is kept in the saturation region by the biasing circuit. Operation of second PMOS transistor 206*b* in the saturation region enables it to respond to any voltage change at its gate terminal.

In the second current mirror circuit 204, the third PMOS transistor 212*a* has a source terminal connected to the voltage source VDD and a drain terminal connected to the gate terminal of the pass transistor 104 by way of the output terminal of the second current mirror circuit 204. The fourth PMOS transistor 212*b* has a source terminal connected to the voltage source VDD, a gate terminal connected to a gate terminal of the third PMOS transistor 212*a*, and a drain terminal connected to its gate terminal and to a drain terminal of the third NMOS transistor 214*a*. The third NMOS transistor 214*a* has a source terminal connected to the ground and a gate terminal connected to a gate terminal of the fourth NMOS transistor 214*b*. The fourth NMOS transistor 214*b* has a drain terminal connected to its gate terminal and a source terminal connected to the ground. The second current source 216 has an input connected to the voltage source VDD and an output connected to the drain terminal of the fourth NMOS transistor 214*b*. The gate terminals of the third and fourth NMOS transistors 214*a*, 214*b* are connected to the input terminal of the second current mirror 204 by way of the third capacitor C3.

The second current mirror 204 also includes a biasing circuit for the third NMOS transistor 214*a*. The biasing circuit includes the fourth NMOS transistor 214*b* and the second current source 216. During steady-state operation of the voltage regulator 200, the third NMOS transistor 214*a* operates in the saturation region and is kept in the saturation region by the biasing circuit. Operation of third NMOS transistor 214*a* in the saturation region enables it to respond to any voltage change at its gate terminal.

The voltage regulator 200 generates an output voltage signal across the resistors R1 and R2. In the voltage regulator 200, the resistors R1 and R2 are used to generate the scaled-down version of the output voltage signal, which is fed to the error amplifier 102. The error amplifier 102 receives a reference voltage signal, generated by an external voltage reference circuit and compares the reference voltage signal and the scaled-down version of the output voltage signal to generate an error amplified signal. The error amplified signal is fed to the gate terminal of the pass-transistor 104. In an embodiment of the present invention the pass-transistor 104 is a PMOS transistor. A change in the gate voltage of the pass transistor 104 varies the magnitude of the drain current of the pass-transistor 104, and the change in the magnitude of the drain current varies the magnitude of output voltage signal.

The load (not shown) connected to the drain terminal of the pass-transistor 104 draws current from the voltage regulator 200, known as load current. During steady-state operation of the voltage regulator 200, the load draws a constant current from the voltage regulator 200.

If the magnitude of the load current abruptly increases due to a change in the characteristics of the load attached to the voltage regulator 200, the increase in the load current leads to a drop in the output voltage. The voltage drop is sensed by the second and third capacitors C2 and C3 coupled to the gate terminals of the second PMOS transistor 206*b* and the third NMOS transistor 214*a*, thus the voltages at the gate terminals of the second PMOS transistor 206*b* and third NMOS transistor 214*a* drop. The third NMOS transistor 214*a* enters into cut-off region and the second current mirror 204 goes inactive. On the other hand, the drop in the gate voltage of the second PMOS transistor 206*b* increases the magnitude of $V_{sg}$ voltage of the second PMOS transistor 206*b*. The increase in the $V_{sg}$ voltage of the second PMOS transistor 206*b* in turn, increases the drain current of the second PMOS transistor 206*b*. The increased drain current passes through the second NMOS transistor 208*b* and is mirrored by the first NMOS transistor 208*a*. As a result, the increased drain current of the first NMOS transistor 208*a* is fed to the gate terminal of the pass-transistor 104. The increased gate current, in turn, drops the gate voltage of the pass-transistor 104. This drop in gate voltage leads to an increase in the magnitude of the $V_{sg}$ voltage of the pass-transistor 104. The increase in the magnitude of the $V_{sg}$ voltage increases the magnitude of the drain current from the pass-transistor 104. As a result, the output voltage is pulled up by the increased drain current of the pass-transistor 104. Thus, the output voltage is brought back to the predetermined value.

Figure 3:
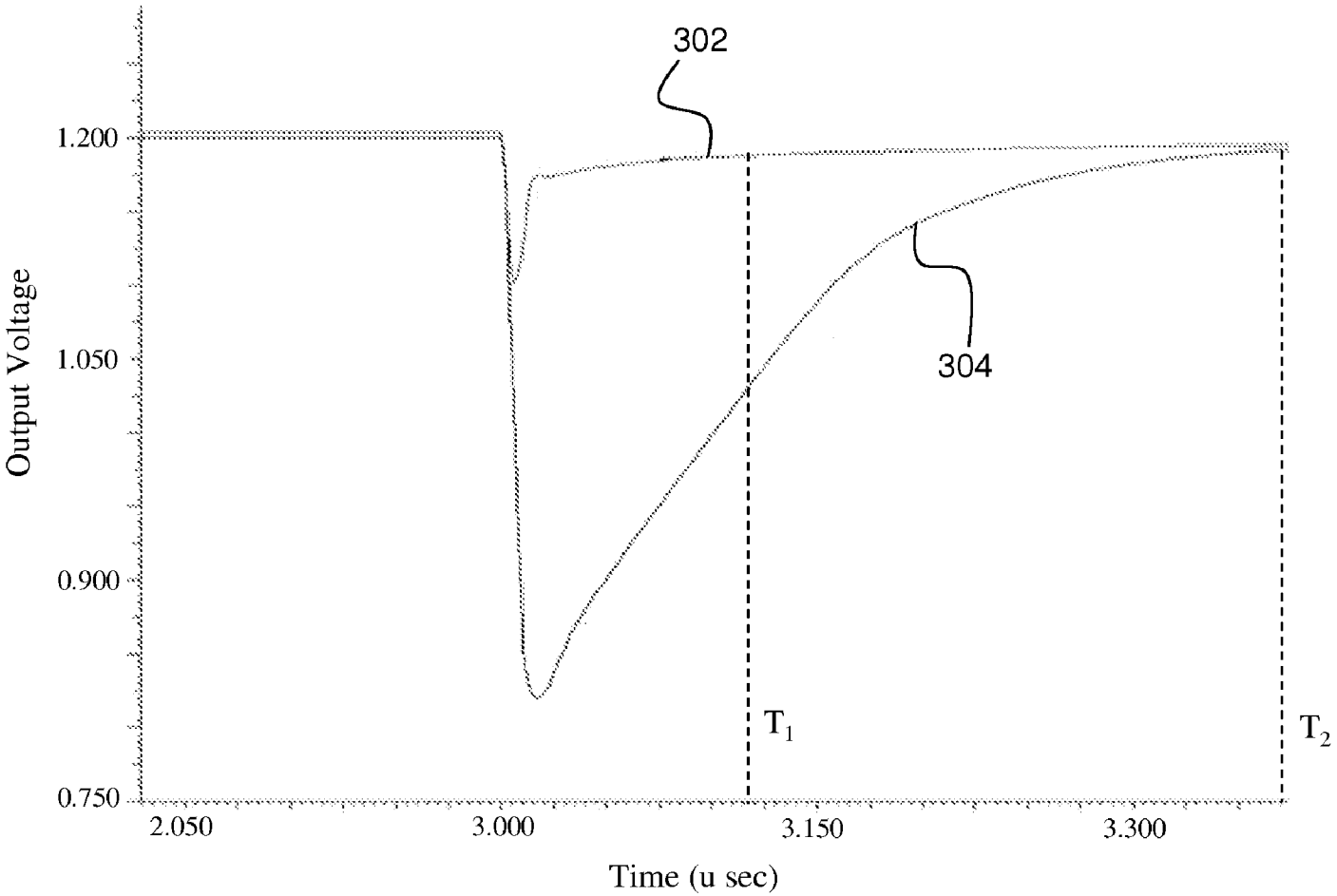
FIG. 3 is a transient response graph for an LDO regulator in accordance with an embodiment of the present invention.

The above instance is depicted in FIG. 3, which is a graph comparing the transient response of the LDO regulator 200 with that of the conventional regulator 100. Line 302 shows the transient response of the regulator 200 and line 304 shows the transient response of the conventional LDO regulator 100. As can be seen from lines 302 and 304, the line 302 reaches its steady state at time instant $T_1$, which is a much faster response than that of the conventional regulator 100 which returns to steady-state at time instant $T_2$. Also, as can be seen from the lines 302 and 304, the line 302 indicates much less output voltage drop as compared to line 304. Thus, the LDO regulator 200 of the present invention has better transient response in terms of voltage drop and settling time than the conventional LDO regulator 100.

For the case where the magnitude of the load current abruptly decreases due to a change in the characteristics of the load attached to the voltage regulator 200, the output voltage rises. The voltage rise is sensed by the second and third capacitors C2 and C3 and coupled to the gate terminals of the third NMOS transistor 214*a* and second PMOS transistor 206*b*. Thus the gate voltages of the third NMOS transistor 214*a* and the second PMOS transistor 206*b* rise. The second PMOS transistor 206*b* enters into cut-off region and the first current mirror 202 goes inactive. On the other hand, the rise in the gate voltage increases the magnitude of the $V_{gs}$ voltage of the third NMOS transistor 214*a*, which in turn, increases the magnitude of the drain current from the third NMOS transistor 214*a*. The increased drain current passes through the fourth PMOS transistor 212*b* and is mirrored by the third PMOS transistor 212*a*. As a result, the increased drain current is fed to the gate-terminal of the pass-transistor 104, which increases the gate voltage of the pass transistor 104. The rise in gate voltage leads to a drop in the magnitude of $V_{sg}$. The drop in the magnitude of $V_{sg}$ voltage decreases the magnitude of the drain current from the pass transistor 104. As a result, the output voltage is pulled down by the decreased drain current of the pass transistor 104. Thus, the output voltage is brought back to the predetermined value.

Figure 4:
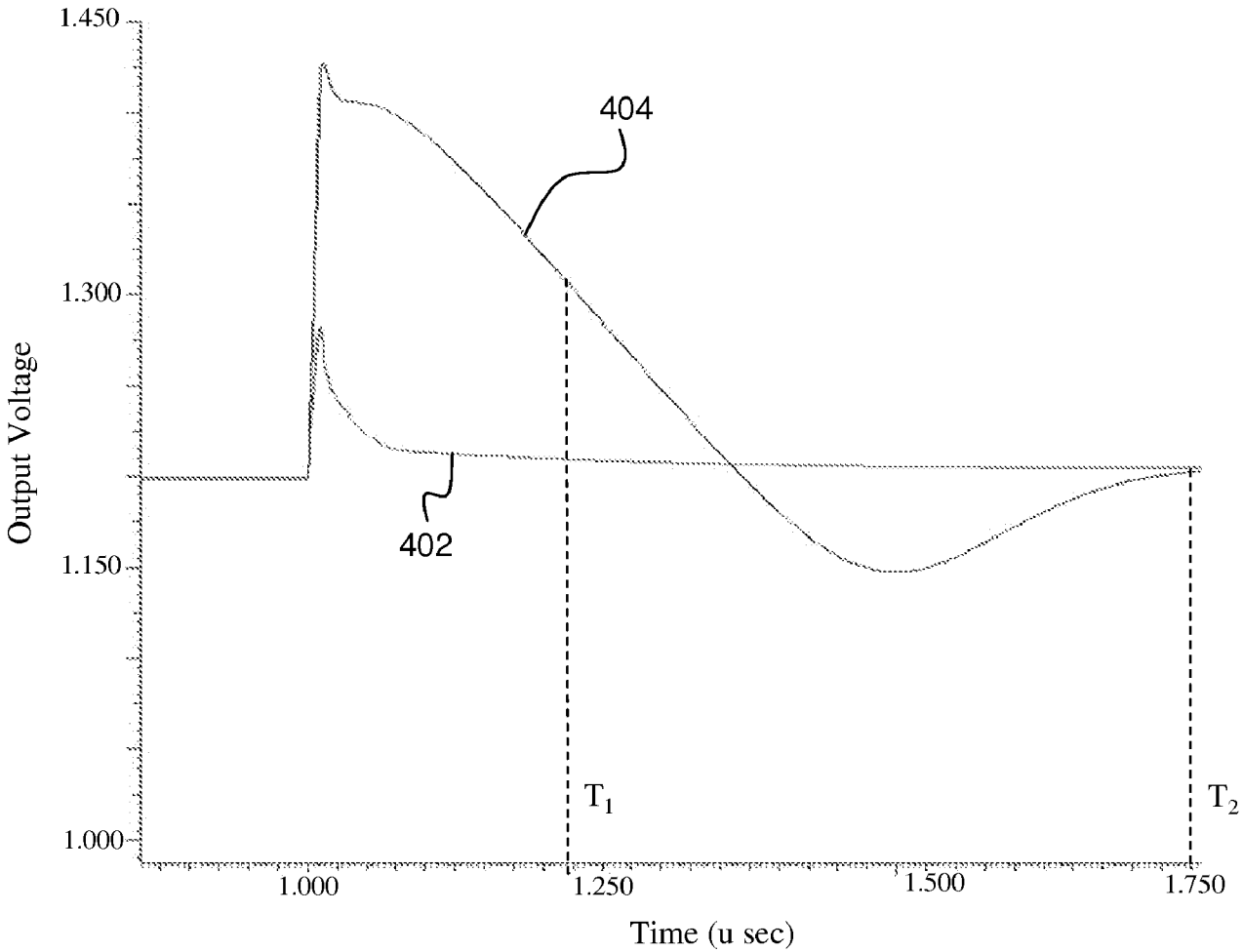
FIG. 4 is another transient response graph for an LDO regulator in accordance with an embodiment of the present invention.

The above instance is depicted in FIG. 4. In FIG. 4, a line 402 shows the transient response of the LDO regulator 200 and a line 404 shows the transient response of the conventional LDO regulator 100. As indicated by line 402, the regulator 200 reaches its steady-state at time instant $T_1$, which is a much faster response than that shown by line 404 for regulator 100, which reaches its steady state at time instant $T_2$. Also, the line 402 shows that the regulator 200 has much less output voltage rise as compared to line 404 of regulator 100. Thus, the LDO regulator 200 of the present invention has better transient response in terms of voltage rise and settling time than the conventional LDO regulator.

While various embodiments of the present invention have been illustrated and described, it will be clear that the present invention is not limited to these embodiments only. Numerous modifications, changes, variations, substitutions, and equivalents will be apparent to those skilled in the art, without departing from the spirit and scope of the present invention, as described in the claims.

What is claimed is:

1. A voltage regulating system that receives an external reference voltage and generates an output voltage, the system comprising:

a low dropout (LDO) regulator that includes:

an error amplifier for comparing the external reference voltage and a scaled-down version of the output voltage to generate an error amplified signal; and a pass transistor having a gate connected to the error amplifier, a source connected to a voltage source, and a drain connected to a load, wherein the pass transistor generates the output voltage based on the error amplified signal;

a transient response circuit, connected to the LDO regulator, for improving a transient response of the LDO regulator, the transient response circuit including:

a first current mirror connected to the pass transistor, wherein an input terminal of the first current mirror is connected to the drain of the pass transistor and an output terminal of the first current mirror is connected to the gate of the pass transistor; and a second current mirror connected to the pass-transistor, wherein an input terminal of the second current mirror is connected to the drain of the pass transistor and an output terminal of the second current mirror is connected to the gate of the pass transistor.

2. The system of claim 1, wherein the first current mirror comprises:

a first capacitor connected to the input terminal of the first current mirror;

a first PMOS transistor having a source terminal connected to the voltage source, and a gate terminal connected to the input terminal of first current mirror by way of the first capacitor and to a drain terminal of the first PMOS transistor;

a second PMOS transistor having a source terminal connected to the voltage source and a gate terminal connected to the gate of the first PMOS transistor;

a first current source connected between the drain terminal of the first PMOS transistor and ground;

a first NMOS transistor having a drain terminal connected to the output terminal of the first current mirror, and a drain terminal connected to the ground; and a second NMOS transistor having a gate terminal connected to the gate terminal of the first NMOS transistor and the drain of the second PMOS transistor, a source terminal connected to the ground, and a drain terminal connected to the drain terminal of the second PMOS transistor.

3. The system of claim 2, wherein the first PMOS transistor and the first current source act as a biasing circuit for the second PMOS transistor, wherein during steady-state operation the second PMOS transistor operates in the saturation region and is kept in the saturation region by the biasing circuit.

4. The system of claim 2, wherein the second current mirror comprises:

a second capacitor connected to the input terminal of the second current mirror;

a third NMOS transistor having a gate terminal connected to the input terminal of the second current mirror by way of the second capacitor, and a source terminal connected to ground;

a fourth NMOS transistor having a gate terminal connected to the gate terminal of the third NMOS transistor, a source terminal connected to the ground, and a drain terminal connected to its gate terminal;

a second current source connected between the voltage source and the drain terminal of the fourth NMOS transistor;

a third PMOS transistor having a source terminal connected to the voltage source, and a drain terminal connected to the output terminal of the second current mirror; and a fourth PMOS transistor having a source terminal connected to the voltage source, a drain terminal connected to a drain terminal of the third NMOS transistor, and a gate connected to its drain terminal and to the gate terminal of the third PMOS transistor.

5. The system of claim 4, wherein the fourth NMOS transistor and the second current source act as a second biasing circuit for the third NMOS transistor, wherein during steady-state operation the third NMOS transistor operates in the saturation region and is kept in the saturation region by the second biasing circuit.

* * * * *